United States Patent [19]

Sirinyan et al.

[11] Patent Number: 4,804,475

[45] Date of Patent: Feb. 14, 1989

[54] METALLIZED MEMBRANE SYSTEMS

[75] Inventors: Kirkor Sirinyan, Bergisch Gladbach; Karlheinz Hildenbrand, Krefeld; Ulrich von Gizycki; Rudolf Merten, both of Leverkusen; Hermann Perrey, Krefeld; Gerhard D. Wolf, Dormagen, all of Fed. Rep. of Germany

[73] Assignee: Bayer Aktiengesellschaft, Leverkusen, Fed. Rep. of Germany

[21] Appl. No.: 47,241

[22] Filed: May 7, 1987

[30] Foreign Application Priority Data

May 10, 1986 [DE] Fed. Rep. of Germany ..... 3615831

[51] Int. Cl.[4] ..... B01D 13/00

[52] U.S. Cl. ..... 210/651; 55/16; 210/652; 210/500.25

[58] Field of Search ..... 55/16, 158; 204/269; 210/496, 510.1, 580.25, 651, 652; 427/244, 245, 246

[56] References Cited

U.S. PATENT DOCUMENTS

| | | | |
|---|---|---|---|
| 2,958,391 | 11/1960 | De Rosset | 55/16 |
| 4,394,020 | 8/1983 | Branchick et al. | 204/269 |
| 4,627,859 | 12/1986 | Zupancil | 264/45.1 X |

*Primary Examiner*—Frank Spear

*Attorney, Agent, or Firm*—Sprung Horn Kramer & Woods

[57] ABSTRACT

Polymer membranes metallized by wet chemistry are highly suitable, for example, for the separation of inert, reactive and fermentation gases.

The metallization is carried out after activation with noble-metal complex compounds which have at least two functional groups.

Preferred metal coatings are those of Cu, Co and Ni.

10 Claims, No Drawings

METALLIZED MEMBRANE SYSTEMS

The invention relates to membranes which are modified by a permeable metallic coating.

Permeability is generally taken to mean the permeation of gases and liquids through separating films. Transport of the permeant through the separating film can take place either i. through pores, free capillaries or cavities and channels, or ii. through diffusion processes in film matrix which is free of flaws and defects (cf., for example, Crank, J. and Park, G. S. "Diffusion in Polymers", Academic Press, New York (1968)).

As is known, the following four steps are essential in the permeation process through a film:

sorption of the permeate onto one of the two film surfaces, migration of the permeate in the film matrix, desorption of the permeate from the other film surface and, transport of the permeate away from the boundary layer of the surface.

In general, it can be said that an atom or a molecule can only penetrate a film if it enters interactions therewith. As a consequence, organic compounds have diffusion and permeation properties which are different to those of solids. This principle has been utilized for some time for the separation of gas and liquid mixtures and for the separation of solids, such as salts, from liquids. In the main, membranes or separating films made of synthetic or natural polymers are employed for this purpose (cf., for example, J. Comyn, "Polymer Permeability" Elsevier Applied Science Publishers, Essex, (1985)).

Depending on the separation or transport mechanism, a distinction is made between reverse osmosis and ultrafiltration (cf., for example, Strathmann, H., "Trennung von molekularen Mischungen mit Hilfe synthetischer Membranen" [Separation of molecular mixtures using synthetic membranes], Steinkopfverlag Darmstadt (1979)).

As is known, ultrafiltration membranes having continuous pores or channels can be produced by partial chemical etching, by ion bombardment or plasma etching, or by drawing a film from a polymer solution which is composed of a mixture of solvents having different evaporation rates.

In the main, so-called "asymmetric membranes" for reverse osmosis and ultrafiltration are produced by means of the phase inversion process (cf., for example, Strahtmann, M.).

The literature reveals that, in the main, organic natural or synthetic plastics are suitable for preparing said membrane systems. In this connection, the following may be mentioned as examples: polyesters, cellulose esters, aliphatic and aromatic polyamides, halogen-containing polymers (such as polytetrafluoroethylene, polyvinylidene fluoride or polyvinylidene chloride), types of polycarbonate, polyimides, polyhydantoins, polyparabanates, polyurethanes, polysulphones, aromatic polyethers, polyethylene oxides and polypropylene oxides, and copolymers and graft polymers thereof.

One important parameter of a separating membrane is the retentivity (R). In the known ultrafiltration membranes, the pore diameter is not a fixed quantity, but instead is a quantity which is determined via the diameter of the pores of different sizes from a statistical distribution function. For this reason, molecules having a small difference in molecular diameter cannot be separated precisely using the membrane systems disclosed hitherto.

A second parameter for the membrane system is the so-called "permeation rate". This permeation rate increases with the number of free channels. However, as the number of free channels is increased the selective separating action decreases rapidly. A further important quality feature of separating membranes is furthermore their chemical and/or thermal stability.

Metallized membranes which are produced by vapour deposition are already known from J. Membrane Science 24 (1985), 297–307, but have the following disadvantages:

(1) The pore structure of the membrane suffers partly irreversible damage during vapour-deposition. In addition, clogging of the pores occurs.

(2) It is only possible to apply very thin metal layers which have a high electrical and thermal resistance and, in addition, cannot be increased in thickness by electroplating.

The invention has for its object to avoid these disadvantages and to modify the chemical and physical nature of known organic membranes in such a fashion that they enter a selective chemical and/or physical interaction with the permeant, thereby making it possible to achieve a sharp separation between molecules having a small difference in molecular weight.

The invention also has for its object to increase the thermal and chemical stability of the membrane matrix without adversely influencing the original physical characteristics, such as pore size or pore distribution, of the membrane matrix.

This object is achieved by treating organic polymer membrane systems having an average pore diameter of 1–10,000 nm with the organometallic compounds of Ag, Au, Pt and/or Pd, if appropriate sensitizing them in a reducing medium, and then providing them with an electrically conductive and permeable metal coating of 0.1–10 μm in thickness in a wet-chemical metallizing bath, and, if appropriate, increasing the thickness of this metallic coating by electroplating.

The metallization of organic polymers is known (see, for example, R. Weiner "Chemische Vernickelung" [Chemical nickel-plating], Eugen, G. Leuze Verlag Saulgau/Wü rtt. (1974)). As is known, plastics are activated either with ionic palladium such as $PdCl_4^{2-}$, $Pd(NO_3)^{2-}$ $PtCl_6^{2-}$, $AuCl_4^-$, Pt-diamine-dinitrate ($Pt(NH_3)_2(NO_2)_2$) in ammonia and $Pt(NH_3)_4^{2+}$ in ammoniacal alkaline saturated $NH_4Cl$ solution, or with colloidal Pd solution.

All these processes have the disadvantage that they require a pretreatment of the plastic surface in a previous step. In addition, strong oxidants, such as chromosulphuric acid, gaseous $SO_3$, $NH_2SO_3H$ or concentrated phosphoric acid, are employed. However, this pretreatment affects not only the chemical nature of the membrane surface, such as the formation of $SO_3H$ groups, but also the physical properties, such as pore size, pore size distribution, separative action, retentivity and mechanical stability, of the membrane matrix.

A further disadvantage of the abovementioned wet-chemical metallization process is that they lead to agglomerate-like metallic deposition, which is in turn associated with irreversible clogging of the membrane pores and the attendant reduction in permeation rates.

It is also possible to obtain metal deposition on plastic surfaces by vapour-deposition of metal in vacuo. The major disadvantages of this process are the following:

The fine membrane structure is physically destroyed by the high energy (≧10 eV) of the metal molecule.

The free channels of the membrane matrix cannot be metallized by the said process.

The adhesion (abrasion resistance) of the metal coating is so low that it cannot be increased in thickness by electroplating.

The said organometallic compounds (see, for example, DE-A-Nos. 3,148,280, -3,150,985 and -3,324,767) which are highly suitable for carrying out the process according to the invention are known. In the main, they are noble metal compounds whose organic part has a further functional group. Compounds of Pd and Pt are preferred.

The groups of the organic part of the organometallic compound which are required for bonding the metal are known per se. They are, for example, C—C or C-N double and triple bonds and groups which are able to form a chelate complex, for example OH—, $NH_2$, SH—, CO—, CS—,

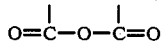

or COOH.

Suitable for chemical attachment of the activator to the substrate surface are functional groups such as carboxylic acid groups, carbonyl halide groups, carboxylic anhydride groups, carboxylic acid ether groups, carboxamide and carboximide groups, aldehyde and ketone groups, ether groups sulphonate groups, sulphonyl halide groups, sulphonic acid ester groups, halogen-containing heterocyclic radical, such as chlorotriazinyl, chloropyrazinyl, chloropyrimidinyl or chloroquinoxalinyl groups, activated double bonds, as in vinylsulphonic acid derivatives or acrylic acid derivatives, amino groups, hydroxyl groups, isocyanate groups, olefine groups and acetylene groups, and also mercapto and epoxide groups, furthermore long-chain alkyl or alkenyl radicals from $C_8$, in particular oleic, linoleic, stearic or palmitic groups. 1,3-Dienes, $\alpha,\beta$-unsaturated ketones and esters, and anhydrides of unsaturated acids are particularly suitable.

If attachment by chemical reaction does not occur, adherence can alternatively be caused by adsorption of the organometallic activators onto the substrate surface, possible causes of adsorption being, for example, hydrogen bonding or van der Waals forces.

It is expedient to match the adsorbtion-causing functional groups to the respective substrate. Thus, for example, long-chain alkyl or alkenyl groups in the activator molecule improve the adherence to polyethylene or polypropylene substrates. In contrast, activators having, for example, additional carbonyl or sulphone groups are particularly favourable for the metallization of polyamide- or polyester-based articles.

Functional groups such as carboxylic acid groups and carboxylic anhydride groups are particularly suitable for attaching the activator to the substrate surface by adsorption.

Another way of carrying out the process is to use guest/host molecules, as described in DE-A-No. 3,424,065 which corresponds to U.S. Pat. No. 4,661,384:

The organic part of these compounds is formed from cryptands, podands and, preferably, from cyclic crown ethers of the formula

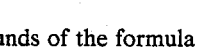

n = 3-10

(cf., for example, Vogtle, F., "Kontakte" [Catalysts] (Darmstadt) (1977) and (1978), Weber, E., "Kontakte" [Catalysts] (Darmstadt) (1984), and Vogtle, F. Chemikerzeitung, 97, pp 600–610 (1973)).

The inorganic part of guest/host molecules is preferably formed (1) from compounds of the formula $$Me^{n+}E^{m+}Hal^{-}{}_{z}$$

in which

Me represents hydrogen, alkali metal, alkaline-earth metal, ammonium or heavy-metal atoms (Fe, Co, Ni or Cu), Hal represents halogen, E represents the elements Pt, Pd, Ag or Au having the valency m and the coordination number z, where z−m=n, or (2) from the cations of the said elements, preferably $$Ag^{+} \text{ or } Au^{+++}$$

or preferably (3) from non-complex salts of the elements of the formula $$E^{m+}Hal^{-}{}_{z}(p=m)$$

or (4) from conventional colloidal systems of these noble metals.

Preferred noble-metal compounds to be used are those having the formula $H_2PdCl_4$, $Na_2(PdCl_2Br_2)$, $Na_2PdCl_4$, $CaPdCl_4$, $Na_4(PtCl_6)$, $AgNO_3$, $HAuCl_4$ and $AuCl_3$. The Pd compounds are preferred.

Suitable colloidal noble metal systems are derived, in particular, from the metals Pd, Pt, Au and Ag, and are described, for example, in "Kunststoffgalvanisierung" [Electroplating of plastics] by R. Weiner, Eugen G. Leuze Verlag, Saulgau/Württ. (1973), pages 180–209.

In the case mentioned in point (1), the electrically neutral ligand absorbs the cation $M^{n+}$ into its endohydrophilic cavity and transports it into the organic solvent phase, the potential difference produced meaning that the part $E^{m+}Hal^{-}{}_{z}$ is cotransported into the desired solvent phase. In principle, this phenomenon is also relevant for the systems which are mentioned in points (2), (3) and (4).

The activation solution can be prepared by dissolving the said organometallic compounds in protic or aprotic solvents in amounts of 0.01–1 g/l, preferably 0.1–2.5, particularly preferably 0.1–1.0 g/l.

Suitable organic solvents are, particularly, polar, protic and aprotic solvents, such as methylene chloride, chloroform, 1,1,1-trichloroethane, trichloroethylene, perchloroethylene, acetone, methyl ethyl ketone, butanol, ethylene glycol, tetrahydrofuran, methanol and ethanol.

Of course, it is also possible to use mixtures of the above solvents and dilutions with other solvents, such as benzine, ligroin, toluene, etc. In the process according to the invention, these solvents are used to wet the surfaces of the substrates to be metallized, the length of treatment preferably being 1 second to 10 minutes. Particularly suitable processes for this treatment are those such as dipping the substrate into the solution or spraying the activating solutions onto the substrate surfaces. Of course, with the new process it is also possible to apply the activating solutions by stamping or by printing processes.

In this context, it may be mentioned that the solvents employed for effecting activation must neither dissolve nor partially swell the membrane matrix. Inert solvents which are suitable for particular polymer membrane systems can be found, for example, in the literature, such as Brandrup, J., Immergut, E. H. "Polymer Handbuch" [Polymer Handbook] (2nd edition) John Wiley and Sons, New York—London—Sydney—Toronto (1975).

After activation, the samples are aftertreated, if appropriate, in a reducing medium. The reduction is preferably carried out in aqueous solution. However, other solvents, such as alcohols, ethers or hydrocarbons, may also be employed. Of course, suspensions or slurries of the reducing agents may also be used.

The surfaces thus treated can be employed directly for currentless metallization. However, it may also be necessary to clean the surfaces by rinsing until free of reducing agent residues.

This embodiment is very particularly suitable for aminoborane-containing nickel baths or formalin-containing copper baths.

Suitable metallization baths which may be employed in the process according to the invention are preferably baths containing nickel salts, cobalt salts, copper salts, gold salts or silver salts, or mixtures thereof with one another, or containing iron salts. Such metallization baths are known in the art of currentless metallization, and preferably contain hypophosphites and boranes as reducing agents.

The average coating thickness of the metallic coating can be 0.01–10 μm, those having a coating thickness of 0.01–5.0 μm being particularly preferred and those having a coating thickness of 0.1–1.0 μm being very particularly preferred.

In this context, it may be mentioned that the Ni, Co and Cu coatings deposited using the preferred baths contain either 0.75–7% by weight of B or 0.75–10% by weight of P, depending on the reducing agent.

The activation of conventional plastic surfaces using the said organometallic compounds normally leads to continuous metal coatings which cover the surface, have a good electrical conductivity, and can be increased in thickness by electroplating.

Surprisingly, the porous organic membranes can be provided with a permeable, but thermaly and electrically conductive and flexible metal coating with the aid of the said systems. It is furthermore surprising that in the course of application the metal coating here adopts the geometry of the membrane, while the pore structure of the membrane matrix is fully retained. This effect is most noticeable with membrane systems which are activated by guest/host complex ligands and then metallized. In addition, it may be mentioned that these systems can be heated by application of an electric current. This effect helps to produce a better separating action and higher flow rates.

Furthermore, it has been found, suprisingly, that the chemical resistance of the membrane matrices for the subsequent chemical metal deposition is increased by the treatment with the organometallic compounds concerned. Thus, for example, polyamide membranes which are activated using the said compounds and then, if appropriate, metallized are distinguished by their high resistance to hydrolysis by oxidants. This is a property which is very important in separating membranes. According to out observations hitherto, organometallic compounds based on Pt, Pd, Au, Ag, Cu, Co and Ni are suitable for obtaining this effect, those based on Pd and Pt being very particularly preferable. Of course, the said organometallic compounds may be employed merely for the doping of membranes.

In addition, it may be mentioned that the permeable metallic coatings deposited by the process according to the invention are good heat and electrical conductors, which leads to a considerable increase in thermostability by preventing local buildup of heat.

The membranes which are suitable for carrying out the process according to the invention can have an average diameter of 1–10,000 nm, those of diameter 1–5,000 nm being particularly preferred and those of diameter 1–1,000 nm whose average values are in the range 10–500 nm being very particularly preferred.

Suitable substrates for the process according to the invention are all membranes based on organic-natural or synthetic polymers. Those based on types of cellulose ester, such as cellulose diacetate or triacetate (see, for example, DE No. 2,621,519 or U.S. Pat. No. 3,133,132), polyamides (see, for example, DE No. 1,941,932), polyureas, such as polyhydantoins and polyparabanates (see, for example, DE No. 2,431,071), polysulphones, polyethers, polyesters, polyether/polypropylene oxides, and halogen-containing polymers, such as Teflon and Tedlar, are particularly highly suited.

For mechanical stabilization, these membranes can also be present fixed to porous support tiles based on polyethylene, polypropylene, polyester or polyamide.

Membrane substrates which contain organic or inorganic fillers and which are suitable for carrying out the process are repeatedly described in the literature (see, for example, DE No. 2,129,014, DE No. 2,140,310, and EP No. 77,509).

Multilayer membranes prepared by the process according to the invention are highly suitable for the separation of reactive gases, such as $NH_3$, $O_2$, CO, NO, $NO_2$, $H_2S$, $Cl_2$ and $F_2$; inert gases, such as He, $N_2$ and $A_2$, and liquefied gases, such as buta-1,2-diene and buta-1,4-diene, and $CO_2$ from gas mixtures, or for the purification of liquids containing anionic, cationic and/or neutral particles.

The following areas of application may be mentioned as examples, without limiting the scope of the many possible applications of multilayer membranes according to the invention.

(I) Gas separation:

In the area of energy technology, the formation of $H_2$ from fermentation gas.

In the area of natural gas processing, the production of He, $CO_2$ or $H_2S$ from natural gas.

In the area of petrochemistry, the enrichment of $H_2$ from refinery gas.

In the area of ecology and environmental protection, the removal of HCl and $SO_2$ from flue gas.

In the area of chemistry, the recovery of $H_2$ from ammonia synthesis.

In medical technology, the enrichment of $O_2$ from the air and removal of $H_2S$ and $CO_2$.

(II) Purification of liquids

In reverse osmosis, for the production of ultrapure water and for the retention of cations, such as $Na^+$, $Ca^{++}$, $Cu^{++}$, $K^+$, $Mg^{++}$ and $Ni^{++}$, or anions, such as $Cl^-$, $SO_2^{--}$, $NO_3^-$ or $HCO_3^-$.

A further preferred possible use of the membranes according to the invention is the separation of ionic or colloidal substances, such as cations or anions, in an electrical field. In this use, the metallized membrane is used as the cathode, if cations are to be removed, or as the anode, if anions are to be removed. An ideal interaction between the metal surface and the ions to be removed is achieved in this fashion, resulting in a great increase in the permselectivity or flow rate. The requisite current density A can be widely varied between 0.001 $A/dm^2$ and the critical decomposition voltage of the media to be separated in a particular case. Preferred current densities are in the range of 0.01–2.0 $A/dm^2$.

Another preferred way of using the metallized membranes according to the invention is in the area of clinical diagnostics. The detection of components such as glucose, urea and haemoglobin in urine, serum or blood corpuscles is carried out to an increasing extent with the aid of test strips (cf., DE No. 3,407,359, DE No. 2,332,760 and EP No. 0,064,710). These test strips comprise, for example, a transparent plastic support and a porous and/or permeable membrane coating. The matrix of the membrane coating contains specific detection reagents, which, by reaction with the analyte to be determined, produce various colour intensities (colour gradations), corresponding to the substrate concentration. These relative analytical methods have the disadvantage that they do not lead to exactly reproducible values. For this reason, attempts are still made to determine the concentration of the abovementioned media by physical methods of measurement.

It has now been found that it is possible to determine the said media with the aid of the membrane systems metallized by processes according to the invention. This is down chiefly by utilizing the change in electrical conductivity of the metal coating as a function of the medium to be determined.

Some possible preparations and uses of the said systems are demonstrated in the examples below without limiting the scope of the invention.

EXAMPLE 1

To prepare test specimens, use is made of the following polymer casting solution:

13.73 g of polyurethane
66.37 g of DMF (dimethylformamide)
7.24 g of polyurethane dispersion in $H_2O$/DMF
0.07 g of sodium dioctylsulphosuccinate
11.01 g of titanium dioxide
0.79 g of 3,3',5,5'-tetramethylbenzidine and
0.79 g of ascorbic acid.

The abovementioned polyurethane is a thermoplastic polymer which is obtained by reaction of 75 parts of a polyester from adipic acid, 70 mol % of ethylene glycol and 30 mol % of 1,4-butanediol (MW=2000), with
25 parts of a polyester from adipic acid and 1,4-butanediol (MW=2250)
25 parts of 1,4-butanediol and
85 parts of diphenylmethane diisocyanate.

The polyurethane dispersion serves as a coagulation auxiliary and is a cationic, emulsifier-free dispersion of a product of the reaction of
200 parts of a polyester from adipic acid, phthalic acid and ethylene glycol (MW=1700)
50 parts of N-methyldiethanolamine and
6 parts of p-xylylene dichloride.

A polyethylene terephthalate film is coated uniformly with this casting solution in a drawing thickness of 100 μm using a doctor knife. This carrier-supported film is coagulated in a 30% strength aqueous glycerol bath which additionally contains 1% by weight of Na laurylsulphate. The resulting solid, carrier-supported membrane is dried with warm air. A permeable membrane system having a pore diameter distribution of 30–1000 nm, the average pore size being 500 nm, is obtained.

A 10×10 cm square of the abovementioned membrane is activated at RT (room temperature) for 90 seconds in an activating bath which is prepared from 0.25 g of mesityl oxide palladium chloride and 1 liter of tetrachloroethylene, dried at RT, and then nickel-plated, without current, for 15 minutes in an aqueous nickel-plating bath which contains 33 g of $NiSO_4 6H_2O$, 11.5 g of citric acid, 18.5 ml of 2N DMAB (dimethylaminoborane) solution and 2.5 g of boric acid and has been adjusted to pH 5 with a 25% strength ammonia solution. The substrate surface begins to turn grey after about 45 seconds, and, after about 12 minutes, the test specimen had been covered with an electrically conductive, 0.5 μm thick Ni coating containing 2% of boron.

Scanning electron micrographs (SEM) of the system described show that, surprisingly, the metallic coating is porous, its average pore size being identical to the porous polymer coating.

The abovementioned test strip was soaked for 1 minute in a 1% strength peroxidase (POD 277 U/mg)/-glucose oxidase (116 U/mg) solution in citrate buffer (pH 5.5) and dried. A 0.25% strength by weight glucose solution was applied to the membrane surface. The adsorbed amount of glucose can subsequently be determined potentiometrically.

EXAMPLE 2

Membrane with Reagent Layer

Casting solution for the membrane:

20.00 g of polysulphone (product of the condensation of bisphenol A and bischlorophenyl sulphone (Udel P 1700, commercial product from Union Carbide) were dissolved in
80.00 g of N-methylpyrrolidone.

The casting solution is applied (100 ml) to a glass plate using a blade, and, for coagulation, dipped into an aqueous 10% strength glycerol bath. The film separates from the glass support, and a support-free, asymmetric membrane is obtained.

A 150×300 mm rectangle of the abovementioned test specimen is dipped for 30 seconds into a solution of 0.52 g of 3-hepten-2-one-palladium chloride in 500 ml of acetone, dried at room temperature, and then copper-plated for 20 minutes in a reductive Cu bath from Shipley AG, Stuttgart.

After about 30 seconds, the surface begins to darken, and a matt metallic, electrically conductive and permeable coating had been deposited after 5 minutes. The total coating thickness of the Cu coating was about 0.2 μm. SEM studies show that, surprisingly, the metallic coating is porous. Its average pore size is identical to the porous polymer coating. The abovementioned membrane was employed for the separation of a gas, of the following composition, originating from a steam reformer:

| | |
|---|---|
| $CO_2$ | 18.3% by volume |
| CO | 0.4% by volume |
| $H_2$ | 61.0% by volume |
| $N_2$ | 20.0% by volume |
| $CH_4$ | 0.1% by volume |
| Ar | 0.2% by volume |

The permselectivity studies show that the said membrane system is highly suitable for the separation of $H_2$ from the abovementioned gas mixture.

EXAMPLE 3

For the production of test specimens, a polymer casting solution comprising:
15 g of cellulose triacetate,
24 g of dioxane, and
50 g of acetone
is prepared. 10 ml of DMF are subsequently added to the solution. The membrane is produced by knife coating onto glass plates using a coating machine for thin-layer chromatography. After evaporation of the solvent, the membrane film is activated for 30 seconds in an activating solution comprising 0.5 g of 1,4-butadiene-palladium dichloride and 1 liter of methanol, sensitized for 5 minutes in a reductive solution comprising
5 g of DMAB,
1 liter of $H_2O$, and
5.8 g of solid KOH,
washed with distilled water, and subsequently nickel-plated in a commercially available, hypophosphite-containing nickel-plating bath from Blasberg AG, Solingen. After about 12 minutes, the test specimen was covered with a 0.15 μm thick phosphorus-containing nickel layer (7.2% of P).

SEM studies of the abovementioned membrane system show that the coating is highly porous, the average pore size of the metallic coating being 0.05 μm.

The abovementioned metallized membrane system is connected as the cathode in a conventional reverse osmosis analysis at 0.7 Amp/dm$^2$.

The permeation studies show that the said membrane system is highly suitable for the separation of cations, such as $Na^+$, $K^+$, $Ca^+$, $Mg^{2+}$ and $Cr^{3+}$, from aqueous solutions.

EXAMPLE 4

A commercially available porous membrane (average pore size 5 μm) is activated and sensitized according to Example 3, provided with a 0.5 μm thick Cu coating by chemical means according to Example 2, and the Cu coating is then thickened to 3.5 μm in a commercially available CU electroplating bath from Schering AG, Berlin. A highly permeable membrane system is obtained. The pores of the metallic coating are virtually identical to those of the polymer membranes.

Investigations show that the abovementioned two-layer membrane is highly suitable, for example, for the separation of $H_2S$ from $H_2S/N_2$.

EXAMPLE 5

An aromatic copolyamide was prepared from 3-(aminophenyl)-7-amino-2,4-(1H,3H)-quinazolinedione, 3,3-diaminodiphenyldisulphimide and isophthalic acid (cf., German Offenlegungsschrift 2,642,979) and processed into the following casting solution:
10 g of copolyamide
4 g of $CaCl_2$
55 g of DMF and
31 g of $TiO_2$ pigment (Bayer AG)

The casting solution is applied, in a thickness of 100 μm, to a polyethylene support mat. After drying for about 2 minutes at various temperatures, the film is coagulated in a water bath, then dipped in a 30% strength glycerol bath and subsequently dried at 50° C. (cf., EP No. 0,077,509 A 1).

A 10×10 cm square of the abovementioned membrane is activated for 90 seconds at RT in an activating solution comprising 0.7 g of 4-cyclohexene-1,2-dicarboxylic anhydride and 500 ml of $CH_2Cl_2$, and nickel-plated for 30 seconds according to Example 1. A two-component membrane system which is provided with a permeable, electrically and thermally conductive metallic coating is obtained. It is distinguished by a very good thermal stability. With the aid of the said membrane system, which is heated to 80° C. by external application of electric current (6 volts), phenols and aromatic amines, for example, can be successfully separated from aqueous systems.

EXAMPLE 6

8 g of polyhydantoin having the general formula (A) and dimethylacetamide (1:1), and 1.6 g of lithium chloride are added. The blue solution is filtered through a pressure filter, and allowed to stand until it is free of bubbles. From one part of this solution, a film having a thickness of 200 μm is drawn on a glass plate using a mechanical film slide, and then dried for 10 minutes at 60° C. on a hot plate in a fast stream of nitrogen. After cooling for 10 minutes at RT, the film with the glass plate is dipped into an icebath and kept there for ½ hour. The film is treated for 5 minutes in an activating solution comprising 0.01 mol of 1,4,7,10,13,16-hexaoxacycloatadecane $Na_2PdCl_4$ complex compound and 350 ml of $CCl_2{=}CCl_2$, and subsequently provided with a 0.4 μm thick Co coating containing 1.2% of boron in a bath comprising:
33.8 g of $CoCl_2\ 6H_2O$,
12.9 g of citric acid,
18.7 g of 2N DMAB and
5.8 g of boric acid.
This Co coating is thickened to 1.9 μm in a commercially available Pt electroplating bath from Degussa AG. A multilayer membrane having a highly porous and nevertheless, surprisingly, thermally and electrically conductive metallic coating is obtained. This membrane system can be heated to 120° C. by applying an electric current (for example 4 volts) and thus can be employed to excellent effect for the separation of $H_2$ from $H_2/N_2$.

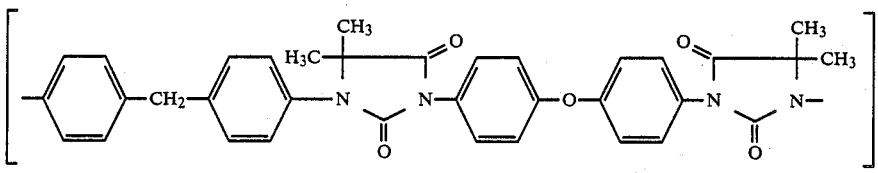

What is claimed is:

1. Metallized membrane systems having a permeable metallic coating of 0.1–10 μm, obtained by currentless wet-chemical metallization of organic polymer membranes after activation with organometallic complex compounds of Ag, Au, Pt and/or Pd whose organic part, in addition to the group necessary for the metal bond, has at least one further functional group.

2. Membrane systems according to claim 1, characterized in that the complex compounds employed contain at least one group of the formula

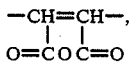

—C=C—, —CN, —OH, —SH, —CO, —CS, —$NH_2$ or —COOH.

3. Membrane systems according to claim 1, characterized in that the complex compounds employed have a guest/host interaction.

4. Membrane systems according to claim 1, characterized in that the complex compounds employed are those of crown ethers, cryptands or podands.

5. Membrane systems according to claim 1, characterized in that the metallic coating comprises boron- or phosphorus-containing Cu, Co or Ni.

6. Membrane systems according to claim 1, characterized in that, the polymer membranes to be metallized are polyesters, cellulose esters, aliphatic and aromatic polyamides, halogen-containing polymers, types of polycarbonate, polyamideimides or polyimides, polyhydantoins, polyparabantes, polyurethanes, polysulphones, aromatic polyethers, polyethylene oxides and polypropylene oxides, and copolymers and graft polymers thereof.

7. In a method of separating cations, the improvement comprising conducting said separation utilizing a membrane system according to claim 1 and wherein said membrane is connected as the cathode.

8. In a method of separating anions, the improvement comprising conducting said separation utilizing a membrane system according to claim 1 and wherein said membrane is connected as the anode.

9. In a method of separating gases or liquids, the improvement comprising conducting said separation utilizing a membrane system of claim 1 and wherein said membrane is heated electrically.

10. In a method of separating gases, the improvement comprising conducting said separation utilizing a membrane system according to claim 1 and said gases being a reactive gases, inert gases, liquified gases or fermentation gases.

* * * * *